US006015770A

United States Patent [19]

Amano et al.

[11] Patent Number: 6,015,770

[45] Date of Patent: Jan. 18, 2000

[54] REVERSIBLE THERMOSENSITIVE RECORDING MATERIAL AND METHOD OF USE THEREOF

[75] Inventors: Tetsuya Amano, Numazu; Yoshihiko Hotta, Mishima; Kunichika Morohoshi, Numazu; Kazumi Suzuki, Shizuoka-ken, all of Japan

[73] Assignee: Ricoh Company, Ltd., Tokyo, Japan

[21] Appl. No.: 08/905,927

[22] Filed: Aug. 5, 1997

[30] Foreign Application Priority Data

Aug. 6, 1996 [JP] Japan ..... 8-221867
Aug. 4, 1997 [JP] Japan ..... 9-221228

[51] Int. Cl.[7] ..... B41M 5/36

[52] U.S. Cl. ..... 503/201; 503/204; 503/226

[58] Field of Search ..... 503/201, 208, 503/209, 204, 226, 214

[56] References Cited

FOREIGN PATENT DOCUMENTS 5-294066 11/1993 Japan ..... 503/201

*Primary Examiner*—Bruce H. Hess
*Attorney, Agent, or Firm*—Cooper & Dunham LLP

[57] ABSTRACT

A reversible thermosensitive recording material which has a substrate and a recording layer formed on the substrate and in which the recording layer assumes a first color state at a first coloring temperature higher than room temperature when the recording layer is heated by applying heat energy in a first color recordable energy range and in which the recording layer then assumes a second color state when heated at a second coloring temperature higher than the first coloring temperature and then cooled, wherein provided that an initial first color recordable energy range is $E_1$ and a changed first color recordable energy range of the recording material which has been preserved at 35° C. for 48 hours is $E_D$, a changing rate $E_c$ of a first color recordable energy range, i.e., $100(E_1-E_D)/E_1$, is less than about 35%.

34 Claims, 2 Drawing Sheets

FIG. 1
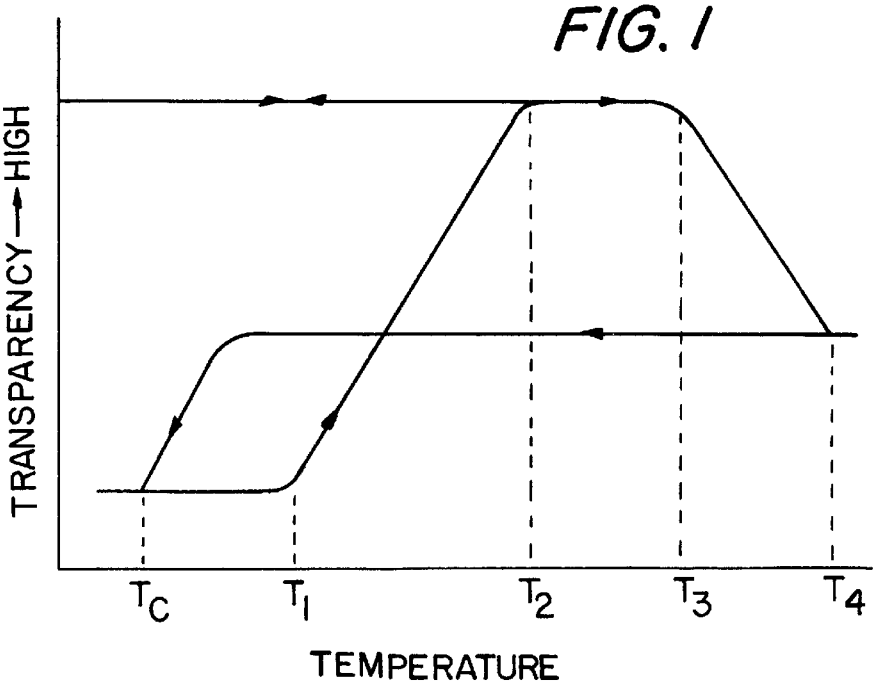
FIG. 2(a)
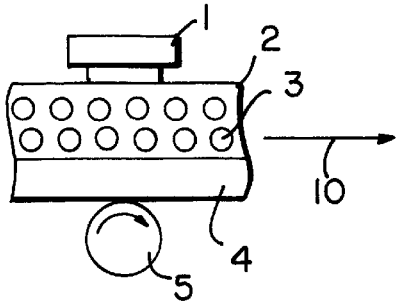
FIG. 2(b)
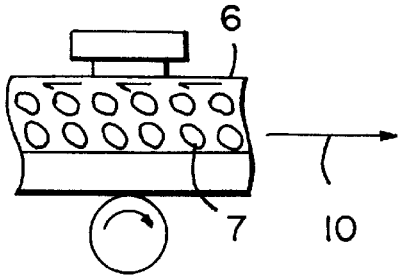
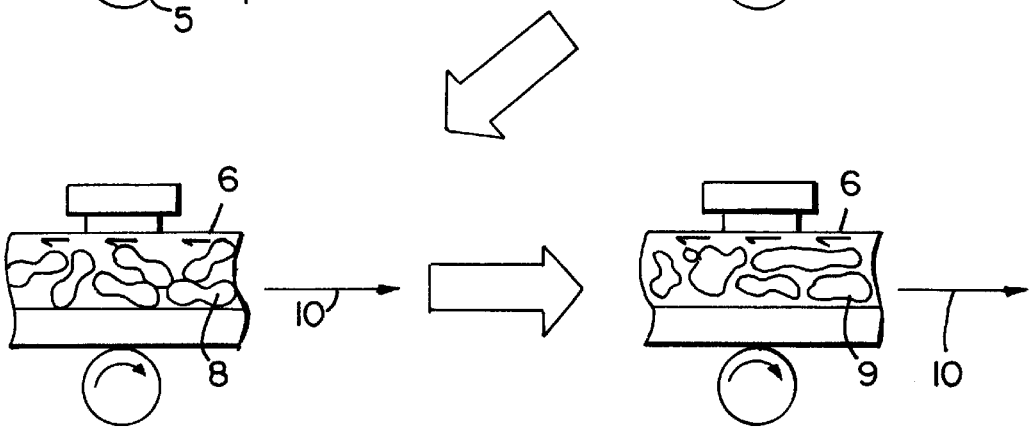
FIG. 2(c)
FIG. 2(d)

REVERSIBLE THERMOSENSITIVE RECORDING MATERIAL AND METHOD OF USE THEREOF

BACKGROUND OF THE INVENTION

1. Field of the Invention

The present invention relates to a reversible thermosensitive recording material, and more particularly a reversible thermosensitive recording material able to repeatedly record and erase images by reversibly changing its transparency or color, as well as to methods of using such a thermosensitive recording material.

2. Disscussion of the Related Art

Reversible thermosensitive recording materials have lately been a subject of interest due to their advantageous ability to reversibly record an image and erase the image when the image is not necessary. For example, Japanese Laid-Open Patent Applications No. 54-119377 and 55-154198 have disclosed reversible thermosensitive recording materials in which a low-molecular-weight organic material such as a higher fatty acid is dispersed in a resin such as a vinyl chloride-vinyl acetate copolymer having a relatively low glass transition temperature of from 50 to 80° C. The reversible thermosensitive recording material records an image using a change between a transparent state and an opaque state thereof; however, it has a drawback that the temperature range in which the reversible thermosensitive recording material is in a transparent state is narrow, i.e., from 2 to 4° C., and therefore temperature control for recording the image is difficult.

In attempting to broaden the temperature range, reversible thermosensitive recording materials have been disclosed in which a low-molecular-weight organic material having a relatively wide temperature range is employed in a recording layer or plural low-molecular-weight organic materials are used in a recording layer (Japanese Laid-Open Patent Applications No. 63-39378, 2-1363, 3-2089 and 5-294066). These reversible thermosensitive recording materials have good image erasability (an ability to erase an opaque image so as to be in a transparent state) when an opaque image is erased by heating with heating media having a relatively long heating time such as heat rollers; however, they have poor image erasability when heated with heating media having a relatively short heating time such as thermal printheads.

In attempting to solve this problem, i.e., poor image erasability when heated with thermal printheads, a reversible thermosensitive recording material has been disclosed which has an appropriate transparent state starting temperature changing rate (the changing rate of the temperature from which the reversible thermosensitive recording material starts to be transparent) of the reversible thermosensitive recording material, or an appropriate transparency changing rate or an appropriate thickness changing rate of the recording layer (International Laid-Open Patent Application No. WO95/20491). The reversible thermosensitive recording material has good image erasability when heated with thermal printheads. Since reversible thermosensitive recording materials are preserved in various environmental conditions because of having the ability of repeatedly recording and erasing images, when even such a reversible thermosensitive recording material having good image erasability with thermal printheads is preserved in high temperature environments after an opaque image is recorded therein, a problem occurs that the opaque image cannot clearly be erased (namely, the erased thermosensitive recording material has lower transparency than ever) by a relatively short time (i.e., a few msec) image erasure using a thermal printhead. Therefore, contrast of an image decreases, and thereby readability of the image deteriorates. This is a new problem and a solution has not heretofore been proposed.

Because of these reasons, a need exists for a reversible thermosensitive recording material which has good contrast of images, i.e., good readability of images, even after the reversible thermosensitive recording material is preserved in an opaque image state (a second color state) under high temperature environments.

SUMMARY OF THE INVENTION

Accordingly, an object of the present is to provide a reversible thermosensitive recording material which has good readability of images, i.e., good contrast of an opaque image (a second color state) with an erased image (a first color state), even after the reversible thermosensitive recording material being in an opaque image state (a second color state) is preserved under relatively high temperature environments.

To achieve this object, the present invention contemplates the provision of a reversible thermosensitive recording material which includes a substrate and a recording layer which is formed on the substrate, the recording layer having first and second color states, and in which the color state of the recording layer becomes a first color state at a first coloring temperature higher than room temperature when the recording layer is heated by heat energy in a first color recordable energy range, and in which the color state of the recording layer then becomes a second color state when the recording layer is heated at a second coloring temperature higher than the first coloring temperature and then cooled, wherein provided that an initial first color recordable energy range is $E_1$ and a changed first color recordable energy range of the recording material which has been preserved at 35° C. for 48 hours is $E_D$, the changing rate $E_c$ of the first color recordable energy range which is represented by the following equation is less than about 35%:

$$E_c=\{(E_1-E_D)/E_1\}\times 100.$$

Preferably, the initial first color recordable energy range of the reversible thermosensitive recording material is greater than about 0.04 mJ/dot and the changed first color recordable energy range is greater than about 0.025 mJ/dot.

In addition, the maximum value of the first color recordable energy range of the reversible thermosensitive recording material is preferably less than about 0.8 mJ/dot.

In another embodiment of the present invention, the reversible thermosensitive recording material includes a reactive polymer in the recording layer.

Preferably, the reactive polymer is included in the recording layer in an amount of from about 5 to about 60% by weight.

In addition, the recording layer preferably includes a resin and a low-molecular-weight organic material dispersed in the resin, wherein the resin is crosslinked by electron beam irradiation, ultraviolet irradiation or heating.

Further, the crosslinked resin has a gel fraction rate more than about 30%.

These and other objects, features and advantages of the present invention will become apparent upon consideration of the following description of the preferred embodiments of the present invention taken in conjunction with the accompanying drawings.

BRIEF DESCRIPTION OF THE DRAWINGS

FIG. 1 is a graph illustrating the relationship between temperature and transparency of a recording layer in an image recording and erasing cycle of a reversible thermosensitive recording material embodying the present invention;

FIGS. 2(*a*)–2(*d*) are schematic diagrams illustrating changes of low-molecular-weight organic material in an image recording and erasing cycle of a conventional reversible thermosensitive recording material;

DESCRIPTION OF THE PREFERRED EMBODIMENTS

Figure 3:
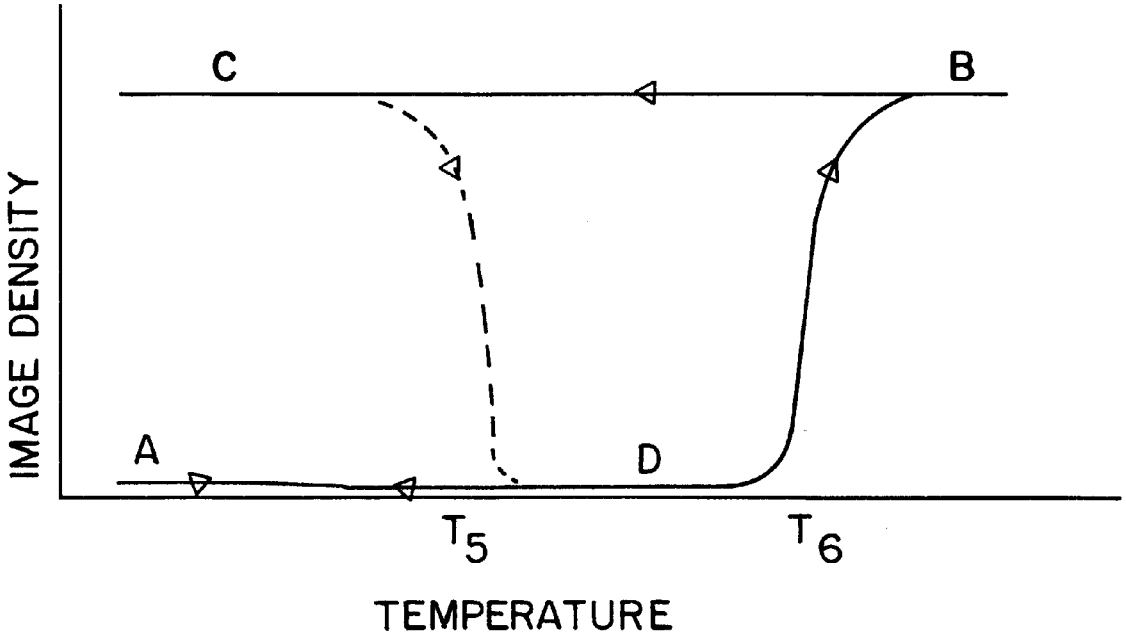
FIG. 3 is a graph illustrating the relationship between temperature and color density of another embodiment of a reversible thermosensitive recording material of the present invention.

Generally, the present invention provides a reversible thermosensitive recording material (hereinafter referred to as a recording material) in which visible changes are reversibly caused to occur in a recording layer depending on environmental temperatures. The visible changes are classified into two types, i.e., changes of color and changes of shape. The changes of color are mainly used for the recording material of the present invention. The changes of color include optical changes of, for example, transparency, reflectance, wave lengths of absorbed light, light scattering degree or the combination thereof. In detailed description, the recording material of the present invention has, for example, a recording layer which assumes a first color state when heated at a first color recordable temperature higher than room temperature and which assumes a second color state when heated at a second color recordable temperature and then cooled.

Specific examples of the recording layer are as follows:

(1) a layer that assumes a transparent state when heated at a first coloring temperature and assumes an opaque state when heated at a second coloring temperature (Japanese Laid-Open Patent Application No. 55-154198);

(2) a layer that assumes a colored state when heated at a second color recordable temperature and assumes a colorless state when heated at a first color recordable temperature (Japanese Laid-Open Patent Applications No. 4-224996, 4-247985 and 4-267190);

(3) a layer that assumes an opaque state when heated at a first color recordable temperature and assumes a transparent state when heated at a second color recordable temperature (Japanese Laid-Open Patent Application No. 3-169590); and (4) a layer that assumes a colored state when heated at a first color recordable temperature and assumes a colorless state when heated at a second color recordable temperature (Japanese Laid-Open Patent Applications No. 2-188293 and 2-188294).

Suitable materials for use in the recording layer which changes its transparency include a low-molecular-weight organic material such as a higher alcohol or higher fatty acid which is dispersed in a resin.

Suitable materials for use in the recording layer which changes its color include a leuco dye having a good reversibility.

Now, a recording layer of reversible thermo-transparency-changing material, i.e., the recording layer which has a resin and a low-molecular-weight organic material dispersed therein and which changes its transparency by changing the temperature of the recording layer is described hereinafter.

The mechanism of the transparency change of the recording layer is considered to be as follows:

In a transparent state, low-molecular-weight organic material particles and a resin dispersing the low-molecular-weight organic material particles contact each other without air gaps and the low-molecular-weight organic material particles have no air gaps therein, and therefore incident light is transmitted through the recording layer without scattering, so that the recording layer appears transparent. In an opaque state, the low-molecular-weight organic material particles are composed of microscopical crystals and air gaps are formed at the interfaces between the microscopic crystals of the low-molecular-weight organic material particles and/or at the interfaces between the resin and the microscopic crystals of the low-molecular-weight organic material particles, and therefore incident light refracts and scatters at the interfaces between the air gaps and the microscopic crystals and/or at the interfaces between the air gaps and the resin, so that the recording layer appears opaque.

FIG. 1 is a graph illustrating the relationship between temperature of a recording layer and transparency of the recording layer. In FIG. 1, the recording layer which includes a resin and a particulate low-molecular-weight organic material dispersed in the resin is in an opaque state at room temperature, i.e., below $T_0$. When the recording layer is heated, the transparency of the recording layer begins to increase at a temperature $T_1$ and the recording layer becomes transparent at a temperature between $T_2$ and $T_3$. If the recording layer in the transparent state is cooled to room temperature, i.e., below $T_0$, transparency of the recording layer is maintained. The mechanism of the phenomena is considered to be as follows:

(1) at about the temperature $T_1$, the resin begins to soften and decreases the air gaps at the interfaces between the low-molecular-weight organic material particles and the resin and/or at the interfaces between the particles themselves, so that the transparency of the recording layer increases;

(2) at temperatures between $T_2$ and $T_3$, i.e., the first color recordable temperature range, the low-molecular-weight organic particles attain a half-melted state and fill the residual air gaps, so that the recording layer becomes transparent; and (3) when the recording layer is cooled, since the low-molecular-weight organic material particles crystallize at a relatively high temperature because seed crystals are present in the low-molecular-weight organic material particles and the resin which is still in a softened state can follow volume changes of the particles caused by the crystallization, an air gap is not formed in the recording layer, so that the transparency of the recording layer is maintained.

When the recording layer is heated to a temperature higher than $T_4$, the recording layer achieves a semi-transparent state which is a medium state between a maximum transparent state and a maximum opaque state. When the recording layer is then cooled, the recording layer returns to the initial opaque state without being in a transparent state. The mechanism is considered to be that when the low-molecular-weight organic material which is entirely melted at a temperature higher than $T_4$ is cooled, the low-molecular-weight organic material attains a super-cooled state and crystallizes at a temperature, slightly higher than the temperature $T_0$, in which the resin (which is not in a softened state) cannot follow the volume changes of the low-molecular-weight organic material; thereby air gaps are formed in the recording layer. FIG. 1 is a typical temperature-transparency relationship of a recording layer of a recording material of the present invention, and the degree of the transparency of each state of the recording layer changes if the materials constituting the recording layer are changed.

In order to improve the rapid erasability with a thermal printhead, therefore, it is considered that the first color recordable temperature range between $T_2$ and $T_3$ should be widened and the deformation speed of the resin should be fast at a temperature higher than the softening point of the resin.

Upon investigating the reason why an erased image has poor transparency and contrast of a newly formed image drops when the opaque image to be erased is erased by a thermal printhead after the opaque image is preserved at relatively high temperature environments, the following results are obtained:

(1) the transparency dropping problem is frequently observed when images are erased by a thermal printhead applying a relatively low heat energy compared to a central value of a first color recordable energy range in which the recording layer being in a second color state, i.e., an opaque state, can be changed into a first color state, i.e., a transparent state;

(2) the transparency dropping problem does not occur when the recording layer is heated with a hot stamp and a heat roller for a time of the order of a few seconds but occurs when the recording layer is heated with a thermal printhead for a time of the order of a few milliseconds;

(3) the first color recordable energy range of the recording material which is preserved in high temperature environments for a long time while being in an opaque state becomes narrower compared with the initial first color recordable energy range before the recording material is preserved in the high temperature environments because the lower limit value of the first color recordable energy range is shifted toward the upper limit value thereof; and (4) the coefficient of tensile elasticity of the recording layer obtained by a Stress-Strain curve of the recording layer in an opaque state preserved at 25° C. for 24 hours is 1.5 times the initial coefficient of tensile elasticity which is measured soon after the recording layer is in an opaque state while the coefficient of tensile elasticity of a recording layer from which a low-molecular-weight organic material is eliminated is not changed after the recording layer is preserved at 25° C. for 24 hours.

In summary, it is considered that, in the recording layer soon after being heated so as to be an opaque state, a part of the melted low-molecular-weight organic material is diffused to the resin of the recording layer, whereby the recording layer is plasticized and the coefficient of tensile elasticity is decreased, and the low-molecular-weight organic material diffused to the resin is changed into particles during preservation in a relatively high temperature environment for a long time, resulting in decrease of the plasticity of the recording layer, i.e., increase of the coefficient of tensile elasticity of the recording layer. By this constitutional change of the recording layer, response to heating for a time of the order of a few milliseconds is considered to be deteriorated, namely, a relatively large amount of heat energy is required to make the recording layer transparent, after the recording layer in opaque state is preserved in relatively high temperature environments for a long time.

Another object of the present invention is to provide a reversible thermosensitive recording material which produces good images when images are repeatedly formed and erased in the reversible thermosensitive recording material.

To solve this problem, a reversible thermosensitive recording material is provided which includes a recording layer which assumes a first color state at a first coloring temperature higher than room temperature when heated by heat energy in a first color recordable energy range and which then assumes a second color state when heated at a second coloring temperature higher than the first coloring temperature and then cooled, wherein provided that an initial first color recordable energy range is $E_1$ and a changed first color recordable energy range of the recording material which has been preserved at 35° C. 48 hours while being in an opaque state is $E_D$, the changing rate $E_c$ of the first color recordable energy range, i.e., $100(E_1-E_D)/E_1$, is less than about 35%. Alternatively, a recording material is provided which includes a recording layer which assumes a first color state when heated at a first coloring temperature higher than room temperature and then assumes a second color state when heated at a second coloring temperature higher than the first coloring temperature and then cooled, wherein the recording layer includes a reactive polymer.

The changing rate of the first color recordable energy range is defined as follows:

(1) the initial first color recordable energy range ($E_1$) is defined as a heat energy range in which a second color image (an opaque image) in a recording material can clearly be erased;

(2) a changed first color recordable energy range ($E_D$) is defined as a heat energy range in which the second color image in the recording material which has been preserved at 35° C. for 48 hours can clearly be erased; and (3) the changing rate ($E_c$) of the first color recordable energy range is defined as $\{(E_1-E_D)/E_1\}\times 100$.

The smaller the changing rate of the first color recordable energy range, the more stably the image of the recording material can be erased by a predetermined heat energy.

In accordance with the invention, the changing rate of the first color recordable energy range is less than about 35%, preferably less than 30% and more preferably less than 25%.

Measurements of the changing rate of the first color recordable energy range are as follows:

(1) second color image recording method

At first, by using a recording tester manufactured by Yashiro Electric Co., Ltd., a suitable second color recordable energy in which the second color image (an opaque image) having a saturated image density can be recorded in a reversible thermosensitive recording material is determined by recording second color images while changing an applied voltage. Recording conditions are as follows:

thermal printhead: EUX-ET8A9AS1 edge-type thermal printhead manufactured by Matsushita Electronic Components Co., Ltd.

dot density of main scanning: 8 dots/mm dot density of vertical scanning: 16 lines/mm applied voltage: (8–15v)

pulse width: 2 msec (1.8–2.2)

cycle time: 2.86 msec/line (2.6–3.2)

recording speed: 21.5 mm/sec (19–23)

pressure of platen roller: 2 kg/cm$^2$

Parenthesized values mean ranges in which each parameter can be changed. The thermal printhead is not limited to EUX-ET8A9AS1. Then a second color (opaque) image is recorded in the recording material by heating by applying the suitable second color recordable energy to the thermal printhead and the recording material is then cooled.

(2) second color image erasing method

The recorded opaque image is immediately erased using the same recording tester. The opaque image is erased with various heat energies by changing the applied voltage (8–15 v). The other recording conditions are the same as those above-mentioned. The erased image is cooled to room temperature and the reflection density thereof is measured with a reflection densitometer RD-914 manufactured by Macbeth Co.

(3) method for obtaining the changing rate of the first color recordable energy range A minimum first color recordable energy and a maximum first color recordable energy are obtained between which the difference between the image density of the erased image and the ground density of the recording layer is kept to be 0.1 or less.

The ground density is obtained by the following processes:

(1) heating the recording layer in an oven so that the recording layer achieves a maximum transparent state:

(2) measuring reflection densities of ten points of the recording layer; and (3) averaging the reflection densities to obtain the ground density.

The difference between the maximum first color recordable energy and the minimum first color recordable energy is the initial first color recordable energy range ($E_1$).

The first color recordable energy range of the recording material which has been preserved at 35° C. for 48 hours while being in a second color state (an opaque state) is also measured by the above-mentioned method to obtain a changed first color recordable energy range ($E_D$).

In this case, if the minimum first color recordable energy of the preserved recording material is less than that of the initial recording material, the minimum first color recordable energy is considered to be the same as that of the initial recording material. Similarly, if the maximum first color recordable energy of the preserved recording material is greater than that of the initial recording material, the maximum first color recordable energy is considered to be the same as that of the initial recording material. Namely, $E_D$ is less than or equal to $E_1$.

The changing rate ($E_c$) of the first color recordable energy range is obtained by the following equation:

$$E_c(\%)=\{(E_1-E_D)/E_1\}\times 100$$

wherein $E_1$ and $E_D$ are the initial first color recordable energy range and the changed first color recordable energy range, respectively, whose units are mJ/dot.

By using a recording material whose initial first color recordable energy range and changed first color recordable energy range are greater than about 0.04 mJ/dot and greater than about 0.025 mJ/dot, respectively, an opaque image can clearly be erased even by heating for a short time of the order of a few milliseconds using a thermal printhead.

In addition, by using a recording material whose maximum first color recordable energy is less than 0.8 mJ/dot, good image formation and good image erasure can repeatedly be performed for a long time without damaging a thermal printhead.

In the present invention, when a reactive polymer is added to the recording layer, the changing rate of the first color recordable energy range of the recording layer is dramatically improved and the initial first color recordable energy range can also be widened.

The reason for the widening of the initial first color recordable energy range is considered to be that the melting point of the resin in the recording layer shifts to a lower temperature by an interaction of the reactive polymer with the resin and therefore the heat sensitivity of the recording layer is increased when a thermal printhead is used for recording, whereby the initial first color recordable energy range can be widened. In addition, since there is no or little interaction between the reactive polymer and the low-molecular-weight organic material, the changing rate of the first color recordable energy range of the recording layer can be improved because of preventing the change of the coefficient of the tensile elasticity caused by an interaction between the resin and the low-molecular-weight organic material.

The content of the reactive polymer in the recording layer is from about 5 to about 60%, preferably from 5 to 50%, and more preferably from about 5 to about 40%.

Suitable reactive polymers for use in the recording layer of the recording material of the present invention include a polymer having a chemical reactivity, i.e., a polymer having a functional group, which is manufactured, for example, by polymerizing a reactive monomer or adding a functional group to a polymer. Specific examples of the reactive polymers include a polymer which has one or more main chains such as methyl (meth)acrylate, butyl (meth)acrylate, polystyrene, polyolpoly(meth) acrylate, modified polyolpoly(meth)acrylate, polyesteracrylate, urethaneacrylate, epoxyacrylate and melamineacrylate, and which has a functional group such as an acryloyl group, a methacryloyl group or the like. More concretely, suitable reactive polymers for use in the recording layer of the recording material of the present invention include the following polymers:

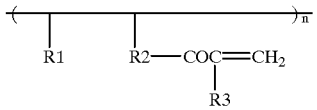

wherein R1 is an alkyl group, R2 is an ester bonding, R3 is a hydrogen atom or a methyl group and n is an integer. In this case, the main chain includes polymethyl methacrylate, polybutyl acrylate, polystyrene, copolymers thereof or the like. The reactive polymers have a relatively high viscosity, and therefore a monomer having a functional group such as acrylate or methacrylate monomers may be added thereto as a diluent. Specific examples of such monomers include monomers disclosed in Japanese Laid-Open Patent Application No. 07-172072. The reactive polymers for use in the recording layer of the recording material of the present invention are not limited thereto.

The molecular weight of the reactive polymer is greater than 10,000, preferably greater than 20,000 and more preferably greater than 30,000.

Next, another problem in which the image density or contrast of a recording material degrades when an image is repeatedly formed and erased in the recording material and the solution thereof are described hereinafter. By observation of a recording process in which an image is recorded in a recording material with a thermal printhead which contacts the recording material with pressure, the mechanism of the problem is considered to be as follows:

FIGS. 2(*a*) to 2(*d*) are schematic diagrams illustrating changes of low-molecular-weight organic material particles in a recording layer of a conventional reversible thermosensitive recording material. Reference numeral 1 denotes a thermal printhead, reference numeral 2 denotes a resin, reference numeral 3 denotes low-molecular-weight organic material particles, reference numeral 4 denotes a substrate, for example, a PET (polyethylene terephthalate) film, reference numeral 5 denotes a platen roller, reference numeral 6 denotes a shear stress, reference numeral 7 denotes the low-molecular-weight organic material particles deformed by the shear stress 6, reference numeral 8 denotes an aggregated particle of the deformed low-molecular-weight organic material particles, reference numeral 9 denotes grown aggregate of the deformed low-molecular-weight organic material particles and reference numeral 10 denotes the feeding direction of the recording material.

As shown in FIG. 2(*a*), low-molecular-weight organic material particles 3 are not distorted and are uniformly dispersed in a resin 2 in a recording layer when the recording layer has not ever received, or has received only a few cycles of, heat application for forming or erasing images. When the recording material is fed in the direction indicated by the arrow 10 while a heater such as the thermal printhead 1 is contacting the recording material with pressure for forming an image, the shear stress 6 is applied to the inside of the recording layer. When the shear stress 6 is repeatedly applied, distortion is generated in the recording layer in the direction indicated by the arrows 6 shown in FIG. 2(*b*); thereby the low-molecular-weight organic material particles become the deformed low-molecular-weight organic material particles 7. When the shear stress 6 is further repeatedly applied, the distortion of the low-molecular-weight organic material particles is developed; thereby the aggregated particles 8 of the deformed low-molecular-weight organic material particles are formed in the recording layer as shown in FIG. 2(*c*). Finally, the aggregated particles 8 of the deformed low-molecular-weight organic material particles aggregate with each other, resulting in formation of the grown aggregated particles 9 as shown in FIG. 2(*d*). An image cannot be recorded in such a state of the recording layer having the grown aggregated particles 9 of the deformed low-molecular-weight organic material particles. This is considered to be the reason why the image density or contrast of a recording material degrades when images are repeatedly formed and erased in the recording material.

For solving this problem, it is effective to provide a recording material in which the resin in the recording layer has a gel fraction rate more than 30% which is crosslinked using electron beam irradiation, ultraviolet light irradiation or heating.

This is because the crosslinked resin has excellent heat resistance and excellent mechanical strength; thereby the aggregated or the grown aggregated particles of the low-molecular-weight organic material particles are not formed and therefore the image density or the contrast of the recording material does not degrade even when images are repeatedly formed and erased in the recording material.

The gel fraction rate should be greater than about 30%, preferably greater than about 50%, more preferably greater than about 70%, and even more preferably greater than about 80%.

Measurements of the gel fraction rate are performed by the following processes:

(1) a recording layer is formed on a temporary substrate and irradiated with electron beams or ultraviolet light to be crosslinked;

(2) the recording layer is released from the substrate and the recording layer is weighed to determine the initial weight ($W_1$) thereof;

(3) the recording layer is sandwiched in a metal screen of 400 meshes and dipped for 24 hours in a solvent which can dissolve the resin before crosslinking (non-crosslinked resin) included in the recording layer;

(4) the recording layer is pulled out from the solvent and dried in a vacuum to evaporate the residual solvent in the recording layer; and (5) the recording layer is weighed to determine the weight ($W_2$) after solvent soluble components in the recording layer are removed therefrom.

The gel fraction rate of the recording layer is measured by the following equation:

$$\text{gel fraction rate } (\%)=\{W_2/(W_1-W_{LM})\}\times 100$$

wherein $W_{LM}$ is the weight of the low-molecular-weight organic material included in the recording layer, which material is also removed from the recording layer by the solvent.

The weight of the low-molecular-weight organic material, $W_{LM}$, is obtained by the following methods:

(1) if the formulation of the recording layer is known, $W_{LM}$ is obtained by calculation; and (2) if the formulation of the recording layer is not known, $W_{LM}$ is obtained by the following method;

(a) a cross section of the recording layer is observed by a transmission electron microscope (TEM) or a scanning electron microscope (SEM) to obtain a ratio of the cross sectional area of the low-molecular-weight organic material to the total cross sectional area of the recording layer, which is equal to the volume ratio (R) of the low-molecular-weight organic material to the recording layer, and (b) provided that each specific gravity of the low-molecular-weight organic material and the resin is $\rho_{LM}$ and $\rho_R$, respectively, $W_{LM}$ is obtained by the following equation:

$$W_{LM}=W_1\times R\rho_{LM}/\{R\rho_{LM}+(1-R)\rho_R\}.$$

In addition, if an additional layer is formed on the recording layer or formed between the substrate and the recording layer, the gel fraction rate of the recording layer should be measured after the additional layer is clearly removed from the recording layer.

Figure 4:
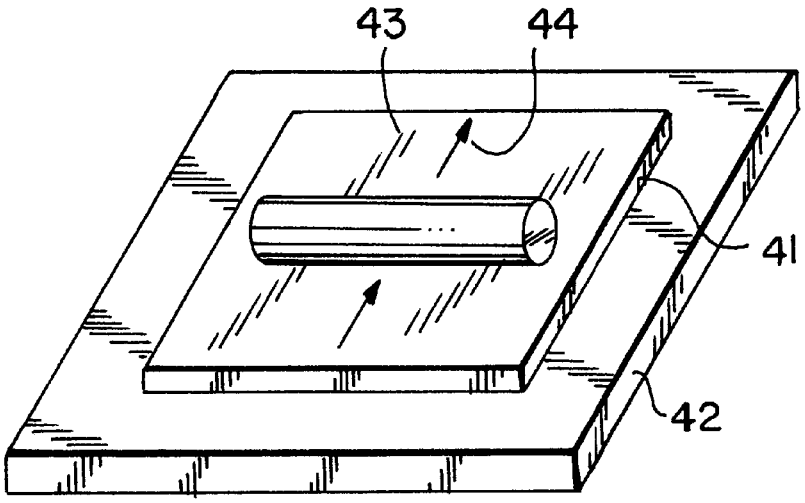
FIG. 4 is a schematic diagram illustrating a cutting apparatus useful for removing a protective layer formed in a recording layer when measuring a gel fraction rate of a resin included in the recording layer.

A suitable cutting apparatus for removing a protective layer formed on the recording layer is shown in FIG. 4. As shown in FIG. 4, a recording material 41 is fixed on a stainless steel plate 42 2 mm thick so that the substrate of the recording material contacts the plate. A surface scraping member 43, constituted of a brass cylinder having a diameter of 3.5 cm whose outer surface is wound by sandpaper of #800, is set on the recording material 41 and is moved in a direction 44 while pressed under pressure of 1.0 to 1.5 kg/cm$^2$ and supported so as not to be rotated. The surface of the recording material is scraped so that the additional layer is completely removed from the recording material. If a difference between each thickness of the recording material measured by a micrometer before and after the scraping is greater than the thickness of the additional layer, the additional layer is completely removed.

By the same method as mentioned above, an intermediate layer formed between the substrate and the recording layer, a printing layer formed on the protective layer, a film layer superimposed on the recording layer or the like can also be removed to measure the gel fraction rate of the recording layer.

The gel fraction rate can also be measured by one of the following methods:

(1) a method in which the recording layer is set in a Soxhlet's extractor which contains a solvent dissolving uncured components in the recording layer and subjected to an extraction treatment for 4 hours to remove the uncured components from the recording layer;

(2) a method in which a crosslinked recording layer formed on a PET film is dipped in a solvent which dissolves uncured components in the recording layer, pulled out from the solvent and dried to obtain a difference between the thickness of each recording layer before and after the dipping treatment; and (3) a method in which a drop of about 0.2 ml of a solvent is dropped on a crosslinked recording layer formed on a PET film, allowed to settle for 10 sec, wiped out and dried, and then the difference between the thickness of each recording layer before and after the solvent dropping operation is determined.

In the method (1), the gel fraction rate is obtained by the same method as mentioned above. In the methods (2) and (3), the gel fraction rate is roughly obtained as a ratio of the thickness after the dipping treatment (or the solvent dropping operation) to the thickness before the dipping treatment (or the solvent dropping operation).

Suitable methods for crosslinking the resin in the recording layer include heating, ultraviolet light irradiation (UV irradiation) and electron beam irradiation (EB irradiation) Among these methods, UV irradiation and EB irradiation are preferable, and the EB irradiation method is the most preferable. Advantages of the EB irradiation method are as follows:

(1) being able to instantaneously crosslink a resin because of utilizing a radical reaction;

(2) not requiring a photo polymerization initiator, a photosensitizer, a catalyst nor a promoter and therefore there is no adverse effect of deteriorating durability of the recording layer;

(3) being able to form a heat stable recording layer and therefore a good image having a high image density, i.e., a high contrast image, can repeatedly be obtained for a long time even when a relatively high heat energy is applied to the recording layer; and (4) being able to form a relatively thick recording layer compared with the other methods.

The above-mentioned reversible thermosensitive recording material of the present invention has a recording layer which can repeatedly form an opaque image on a transparent background or a transparent image on an opaque background. When the recording material having the image is used as a sheet for OHP (over head projection), the opaque area is projected as a dark area and the transparent area is projected as a light area. In addition, when a colored sheet is disposed under the recording layer, the recording material can form a white image on a colored background whose color is the same as that of the colored sheet or an image having the same color as that of the colored sheet on a white background.

The thickness of the recording layer is preferably from about 1 to about 30 $\mu$m, and more preferably from about 2 to about 20 $\mu$m to maintain good image contrast.

The recording material is manufactured, for example, by one of the following methods. The recording layer of the recording material of the present invention may be formed on a substrate or formed alone without a substrate.

(1) A recording layer coating liquid in which a resin and a low-molecular-weight organic material are dissolved or dispersed is coated on a substrate and dried to form a recording layer on the substrate while being crosslinked. The coated recording layer can either be dried while being crosslinked or crosslinked after drying. The coated recording layer can be crosslinked while on the substrate or crosslinked after being removed from the substrate.

(2) A resin and a low-molecular-weight organic material are melted and mixed to prepare a recording layer coating liquid without a solvent, and the recording layer coating liquid is then coated on a substrate, cooled to form a recording layer on the substrate, and crosslinked. The formed recording layer can be used after being released from the substrate.

Suitable solvents for use in the recording layer coating liquid include tetrahydrofuran, methyl ethyl ketone, methyl isobutyl ketone, chloroform, carbon tetrachloride, ethanol, toluene and benzene. The solvent should be selected depending on the qualities of the resin and the low-molecular-weight organic material. When a recording layer coating liquid is a solution as well as a dispersion, the formed recording layer has particles of the low-molecular-weight organic material therein.

Suitable resins useful for resin in the recording layer include a resin which has good transparency and mechanical stability. Specific examples of the resin include polyvinyl chloride; vinyl chloride copolymers such as vinyl chloride-vinyl acetate copolymers, vinyl chloride-vinyl acetate-vinyl alcohol copolymers, vinyl chloride-vinyl acetate-maleic acid copolymers, vinyl chloride-acrylate copolymers and copolymers of vinyl chloride and a vinyl ester of a fatty acid having three or more carbon atoms; vinylidene chloride copolymers such as polyvinylidene chloride, vinylidene chloride-vinyl chloride copolymers and vinylidene chloride-acrylonitrile copolymers; and poly(meth)acrylate copolymers.

The recording layer may include one or more additional resins together with the above-mentioned resin. Specific examples of the additional resins include saturated polyester resins, polyethylene, polypropylene, polystyrene, polymethacrylates, polyamides, polyvinyl pyrrolidone, natural rubber, polyacrolein, polycarbonate, polyacrylates, polyacrylamide, polysiloxane, polyvinyl alcohol and copolymers thereof.

When a polyvinyl chloride copolymer is used for the recording layer of the recording material of the present invention, the polyvinyl chloride copolymer preferably has a degree of polymerization greater than about 300 and more preferably greater than about 600, and the ratio of vinyl chloride to other monomers to be copolymerized is preferably from about 90/10 to about 40/60 and more preferably from about 85/15 to about 50/50.

In addition, the resin used for the recording layer of the recording material of the present invention preferably has a transition temperature (Tg) less than about 100° C., more preferably less than 90° C., and even more preferably less than 80° C.

Suitable low-molecular-weight organic materials for use in the recording layer of the recording material of the present invention include a low-molecular-weight organic material which is in particulate form in the recording layer and has a melting point of from about30to about 200° C. and more preferably from about 50 to about 150° C. Specific examples of the low-molecular-weight organic material include alcohols; alkane diols; halogenated alcohols and halogenated alkane diols; alkyl amine; alkane; alkene; alkyne; halogenated alkane; halogenated alkene; halogenated alkyne; cycloalkane; cycloalkene; cycloalkyne; saturated mono- or dicarboxylic acids and esters, amides or ammonium salts thereof and unsaturated mono- or dicarboxylic acids and esters, amides or ammonium salts thereof; saturated or unsaturated halogenated carboxylic acids and esters, amides or ammonium salts thereof; allylcarboxylic acids and esters, amides or ammonium salts thereof; halogenated allylcarboxylic acids and esters, amides or ammonium salts thereof; thioalcohols; thiocarboxylic acids and esters, amides or ammonium salts thereof; and carboxylic acid esters of thioalcohol. These materials are employed alone or in combination. In addition, the carbon number of these materials is from about 10 to about 60, preferably from about 10 to about 38 and more preferably from about 10 to about 30. The alcohol groups in the above-mentioned esters may be saturated, unsaturated or halogenated. The low-molecular-weight organic material for use in the recording layer of the present invention preferably includes at least one of groups or atoms such as —OH, —COOH, —$CONH_2$, —COOR, —NH—, —$NH_2$, —S—, —S—S—, —O—, a halogen atom or the like.

The recording layer of the recording material of the present invention preferably includes both of a low-molecular-weight organic material having a relatively low melting point and a low-molecular-weight organic material having a relatively high melting point to widen a first color recordable temperature range in which the recording layer maintains transparency. The difference between the melting points is preferably greater than about 20° C., more preferably greater than about 30° C. and even more preferably greater than about 40° C.

The melting point of the low-molecular-weight organic material having a relatively low melting point is preferably from about 40 to about 100° C. and more preferably from about 50 to about 80° C., and the melting point of the low-molecular-weight organic material having a relatively high melting point is preferably from about 100 to about 200° C. and more preferably from about 110 to about 180° C.

Among the above-mentioned low-molecular-weight organic materials having a relatively low melting point, fatty acid esters, dibasic fatty acid esters and fatty acid diesters of polyhydric alcohol are preferable and these materials are employed alone or in combination. These materials have a relatively low melting point compared with a fatty acid (two molecules associated state) having the same carbon atoms and have more carbon atoms than a fatty acid having the same melting point. The low-molecular-weight organic material is preferably incompatible with the resin in the recording layer to maintain the first color recordable energy range constant and preferably has good opacity to obtain good contrast of images. The more carbon atoms the low-molecular-weight organic material has, the more incompatible with resins the low-molecular-weight organic material becomes and the higher opacity the low-molecular-weight organic material has. Therefore, these materials above-mentioned are suitable for the low-molecular-weight organic material in the recording layer of the present invention. These materials are preferably employed together with a low-molecular-weight organic material having a relatively high melting point to widen the temperature range in which the recording layer maintains transparency and to improve the image erasability of the recording material.

Suitable fatty acid esters useful as a low-molecular-weight organic material in the recording layer of the present invention include a compound represented by the following formula (I):

$$R_1—COO—R_2 \quad (I)$$

wherein $R_1$ and $R_2$ independently represent an alkyl group having 10 or more carbon atoms.

The total carbon number of these fatty acid esters is preferably equal to or greater than 20, more preferably equal to or greater than 25 and even more preferably equal to or greater than 30 to obtain an image having a good opacity. The melting points of the fatty acid esters are preferably higher than about 40° C. These materials are employed alone or in combination. Specific examples of such a fatty acid ester include octadecyl palmitate, docosyl palmitate, heptyl stearate, octyl stearate, octadecyl stearate, docosyl stearate, octadecyl behenate and docosyl behenate.

Suitable dibasic fatty acid esters useful as a low-molecular-weight organic material in the recording layer of the present invention include a compound represented by the following formula (II):

$$ROOC—(CH_2)_n—COOR' \quad (II)$$

wherein R and R' independently represent a hydrogen atom or an alkyl group having 1 to 30 carbon atoms, and n is an integer of from 0 to 40.

Each carbon number of R and R' is preferably from 1 to 22, and n is preferably from 1 to 30 and more preferably from 2 to 20. The melting point of the dibasic fatty acid esters is preferably higher than about 40° C. Specific examples of the dibasic fatty acid esters include succinic acid esters, adipic acid esters, sebacic acid esters, 1-octadecamethylene dicarboxylic acid esters and 18-octadecamethylene dicarboxylic acid esters.

Suitable fatty acid diesters of polyhydric alcohol useful as a low-molecular-weight organic material in the recording layer of the present invention include a compound represented by the following formula (III):

$$CH_3(CH_2)_{m-2}COO(CH_2)_nOOC(CH_2)_{m-2}CH_3 \quad (III)$$

wherein n is an integer of from 2 to 40, preferably from 3 to 30 and more preferably from 4 to 22, and m is an integer of from 2 to 40, preferably from 3 to 30 and more preferably from 4 to 22.

Specific examples of such fatty acid diesters of polyhydric alcohol include 1,3-propanediol dialkanic acid esters, 1,6-hexanediol dialkanic acid esters, 1,10-decanediol dialkanic acid esters and 1,18-octadecanediol dialkanic acid esters.

Suitable low-molecular-weight organic materials having a relatively high melting point include saturated aliphatic dicarboxylic acids, ketones having a higher alkyl group and semicarbazone derived therefrom, and α-phosphonofatty acids. The melting point of these materials is preferably higher than 100° C.

Specific examples of aliphatic dicarboxylic acids which have a melting point of from about 100 to 135° C. are as follows but are not limited thereto: succinic acid, glutaric acid, adipic acid, pimelic acid, suberic acid, azelaic acid, sebacic acid, undecanedioic acid, dodecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid and docosanedioic acid.

Suitable ketones useful as low-molecular-weight organic materials having a relatively high melting point include compounds which essentially include a ketone group and a higher alkyl group and which may include an aromatic ring or a heterocyclic ring with or without a substituent. The total carbon number of the ketone is preferably more than 16 and more preferably more than 21. Semicarbazones derived from the ketones are also employed as low-molecular-weight organic materials having a relatively high melting point.

Specific examples of such ketones and semicarbazones include 3-octadecanone, 7-eicosanone, 14-heptacosanone, 18-pentatriacontanone, tetradecaphenone, docosanophenone, docosanonaphthophenone and 2-heneicosanosemicarbazone.

Suitable α-phosphonofatty acid compounds useful as low-molecular-weight organic materials having a relatively high melting point include compounds which are produced, for example, by the following method:

(1) a fatty acid is brominated to obtain an α-bromofatty acid;
(2) ethanol is added to the α-bromofatty acid to obtain an α-bromofatty acid ester;
(3) the α-bromofatty acid ester is the reacted with triethyl phosphite while heated to obtain an α-phosphonofatty acid ester; and
(4) the α-phosphonofatty acid ester is then hydrolyzed with concentrated chloric acid and recrystallized to prepare an α-phosphonofatty acid.

These manufacturing procedures by Hell-Volhard-Zelinskin reaction are described in detail in E. V. Kaurer et al, J. Amer. Oil Chem. Soc., 41, 205 (1964) incorporated herein by this reference.

Specific examples of such α-phosphonofatty acid compounds include α-phosphonomyristic acid, α-phosphonopalmitic acid, α-phosphonostearic acid and α-phosphonopelargonic acid.

These compounds excepting α-phosphonopelargonic acid have two melting points.

The weight ratio of the low-molecular-weight organic material having a relatively low melting point to the low-molecular-weight organic material having a relatively high melting point in the recording layer is from about 95/5 to about 5/95, preferably from about 90/10 to about 10/90 and more preferably from about 80/20 to about 20/80.

The recording layer of the recording material of the present invention may include a low-molecular-weight organic material other than these low-molecular-weight organic materials having a relatively low melting point or a relatively high melting point. Specific examples of such a low-molecular-weight organic material include:

Higher Fatty Acids lauric acid, dodecanoic acid, myristic acid, pentadecanoic acid, palmitic acid, stearic acid, behenic acid, nonadecanoic acid, arachic acid, oleic acid or the like;

Ethers $C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—$C_{12}H_{25}$—S—S—$C_{12}H_{25}$,

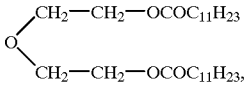

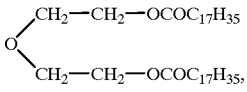

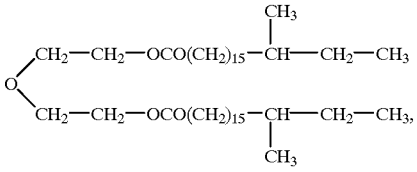

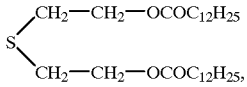

-continued

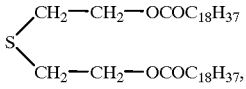

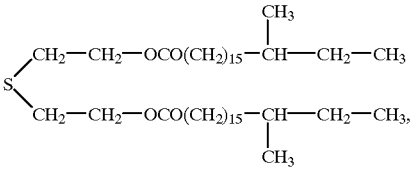

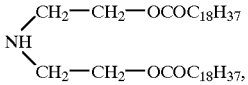

and

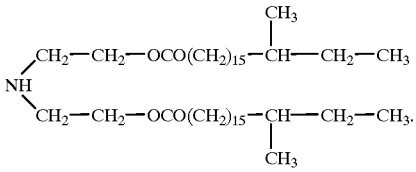

Among these materials, higher fatty acids having carbon atoms more than about 16, and more preferably from 16 to 24, such as palmitic acid, pentadecanoic acid, nonadecanoic acid, arachic acid, stearic acid, behenic acid and lignoceric acid are preferable.

The weight ratio of the total amount of the low-molecular-weight organic materials to the resin (crosslinked resin) is from about 2/1 to about 1/16, and more preferably about 1/2 to about 1/8 to maintain good film formability of the recording layer and good opacity of images.

The recording layer may include auxiliary agents such as surfactants and plasticizers to easily forma transparent image, i.e., a first color image.

Suitable plasticizers for use in the recording layer include phosphoric acid esters, fatty acid esters, phthalic acid esters, dicarboxylic acid esters, glycols, polyester-type plasticizers and epoxy-type plasticizers.

Specific examples of such plasticizers include:

tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, octyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethylbutylate, methyl acetylricinolate, butyl acetylricinolate, butyl phthalyl butylglycolate and tributyl acetylcitrate.

Specific examples of the surfactants and other additives are as follows:

polyol esters of higher fatty acid; higher alkyl ether of polyol; higher alcohol; higher alkyl phenol; higher fatty acid higher alkylamide; higher fatty acid amide; lower olefinoxide adducts of oils, fats or propylene glycol; acetylene glycol; Na, Ca, Ba or Mg salts of higher alkylbenzenesulfonic acid; aromatic carboxylic acid; higher aliphatic sulfonate; aromatic sulfonate; Ca, Ba or Mg salts of sulfuric acid monoester or phosphoric acid mono- or diester; low degree sulfonated oil; long chain alkyl esters of polyacrylate; acrylic oligomers; long chain alkyl esters of polymethacrylate; long chain alkylmethacrylate-amine-containing monomer copolymers; styrene-maleic anhydride copolymers; and olefin-maleic anhydride copolymers.

Since air gaps which differ from a resin and a particulate low-molecular-weight organic material in refractive index are present at interfaces between a resin and a particulate low-molecular-weight organic material and/or in a particle of the low-molecular-weight organic material, the opacity of a formed image increases, resulting in increase of a contrast of the image. The size of the air gaps is preferably greater than one tenth of a wave length of light used for detecting an opaque state of the recording layer.

The recording material may include a light-reflective layer formed between the substrate and the recording layer to increase contrast of an image. When a light-reflective layer is formed, contrast of an image can be increased even when the recording layer is relatively thin. Specific examples of the reflective layer include a layer of a metal, such as Al, Ni, Sn or the like, formed by a vacuum evaporation method. Such a reflective layer is described in detail in Japanese Laid-Open Patent Application No. 64-14079.

Next, another embodiment of the reversible thermosensitive recording material of the present invention is described hereinafter which utilizes color formation by a reaction of a coloring agent such as an electron donating coloring compound with a color developer such as an electron accepting compound.

When a composition including the electron donating coloring compound and the electron accepting compound is heated, an amorphous colored substance is instantaneously produced, and when the amorphous colored substance which is stable even at room temperature is heated again at a temperature below the melting point thereof, the electron accepting compound crystallizes, thereby instantaneously making the amorphous colored substance colorless. The colorless state of the substance is stable even at room temperature. These coloring/erasing operations, i.e., image formation and image erasure operations using this composition, are hereinafter described in detail referring a graph shown in FIG. 3.

In FIG. 3, image density is plotted along the vertical axis and temperature is plotted along the horizontal axis. An image forming process is shown with a solid line, and an image erasure process is shown with a dotted line. A reference character A denotes a density of the recording material in which an image is clearly erased. A reference character B denotes a density of the recording material in which an image is clearly formed by heating the recording material at a temperature above $T_6$. A reference character C denotes a density of the recording material in which the image formed recording material is cooled to a temperature below $T_5$. A reference character D denotes a density of the recording material when the formed image of the recording material is heated again to be erased at a temperature between $T_5$ and $T_6$.

The recording material using this composition is in a colorless state (a first color state), i.e., a state of A, at a temperature below $T_5$. When the recording material is heated at a temperature above $T_6$, with a thermal printhead or the like, the recording material colors, resulting in formation of an image. The formed color image of the recording material is maintained, i.e., the recording material becomes a colored state C (a second color state), if the recording material is cooled to a temperature below $T_5$, which is shown by a solid line ABC in FIG. 3. Thus, image information can be stored in the recording material. When the recording material having the image is heated at a temperature between $T_5$ and $T_6$ which is lower than a coloring temperature, the image is made to be colorless, i.e., the recording material assumes a colorless state D. If the colorless recording material is cooled to a temperature below $T_5$, the colorless state is maintained, i.e., the recording material is in a colorless state A, which is shown by a dotted line CDA in FIG. 3. The image forming and image erasing operations can reversibly be repeated.

This reversible thermo-color-forming material includes a coloring agent and a color developer as essential components, and further includes a binder resin.

A conventional irreversible thermosensitive recording material includes a composition of a coloring agent such as a leuco compound having a lacton ring and a color developer such as a phenolic compound. When this composition is heated to be melted, the leuco compound colors due to opening of the lacton ring; thereby a color image is formed. The colored image is an amorphous substance in which the leuco compound and the phenolic compound are dissolved in each other. The amorphous substance is stable even in room temperature; however, it does not become colorless when heated again because the phenolic compound does not crystallize and therefore the leuco compound cannot reproduce a lacton ring.

On the other hand, although the composition of the coloring agent and the color developer according to the present invention forms a colored amorphous substance, when the amorphous substance is heated again at a temperature below the coloring temperature, the color developer crystallizes to separate from the coloring agent; thereby the electron donation and the electron acceptance between the coloring agent and the color developer cannot be performed and therefore the composition is made to be colorless.

The coloring agent and the color developer for use in the recording material of the present invention include known electron donating coloring agents and known electron accepting color developers. However, these materials should be combined so that a colored amorphous substance can be formed when heated, and the color developer crystallizes when the colored amorphous substance is heated again at a temperature below the coloring temperature. This characteristic of these materials can easily be ascertained by a thermal analysis. By the thermal analysis, melting of these materials can be observed to be endothermic and crystallization of a color developer is observed to be exothermic.

This type of reversible thermosensitive recording material (reversible thermo-color-changing material) may include auxiliary agents such as a binder resin. Even when a binder resin is included in the recording layer, the reversible coloring/erasing operations can be maintained. Specific examples of the binder resin include the resins as aforementioned for use in the above-described recording layer of reversible thermo-transparency-changing recording material.

The resins for use in the recording layers of the reversible thermo-color-changing recording material and the reversible thermo-transparency-changing recording material of the present invention can be crosslinked by heating, UV irradiation and electron beam irradiation. Specific examples of the crosslinking methods are as follows:

(1) crosslinking a crosslinkable resin with heat;
(2) crosslinking a resin with heat in the presence of a crosslinking agent;
(3) crosslinking a resin by irradiation with UV light or electron beams; and
(4) crosslinking a resin by irradiation with UV light or electron beams in the presence of a crosslinking agent.

Suitable crosslinking agents for use in the recording layers of the present invention include oligomers such as polyurethaneacrylates, epoxyacrylates, polyesteracrylates, polyetheracrylates, vinyl oligomers and unsaturated polyesters; and monomers having one or more functional groups such as acrylates, methacrylates, vinylesters, styrene derivatives and allyl compounds. Specific examples of the monomers are disclosed in Japanese Laid-Open Patent Application No. 7-172072. In order to obtain a good crosslinking effect, a monomer having two or more functional groups is preferable for a crosslinking agent. These crosslinking agents are employed alone or in combination.

The content of the crosslinking agent in the recording layeris preferably from about 0.001 to about 1.0 part by weight, and more preferably from about 0.01 to about 0.5 parts by weight, per 1 part by weight of the resin to obtain a good crosslinking effect and good opacity of a formed image.

When a UV light irradiation method is used for crosslinking of the recording layer, the following crosslinking agents, photo polymerization initiators and photo polymerization promotors may be included in the recording layer.

Photopolymerizable Monomers monomers having one or more functional groups such as acrylates, methacrylates, vinylesters, styrene derivatives and allyl compounds.

Photopolymerizable Prepolymers polyesteracrylate, polyurethaneacrylate, epoxyacrylate, polyetheracrylate, oligoacrylate, alkydacrylate and polyolacrylate.

The content of the crosslinking agent in the recording layer is preferably from about0.001 to about1.0 part by weight, and more preferably from about 0.01 to about 0.5 parts by weight, per 1 part by weight of the resin to obtain a good crosslinking effect and good opacity of a formed image.

Photo polymerization initiators are broadly classified into radical reaction type initiators and ion reaction type initiators. The radical reaction type initiators are broadly classified into photo dehiscing type initiators and hydrogen extracting type initiators. Specific examples of the photo polymerization initiators are disclosed in Japanese Laid-Open Patent Application No. 7-172072. These photo polymerization initiators are employed alone or in combination.

The content of the photo polymerization initiators is preferably from about 0.005 to about 1.0 part by weight, and more preferably from about 0.01 to about 0.5 parts by weight, per 1 part by weight of the crosslinking agent.

Photo polymerization promotors can increase a crosslinking speed when used together with a hydrogen extracting type photo polymerization initiator such as benzophenone type initiators and thioxanthene type initiators. Suitable photo polymerization promotors include tertiary amines and aliphatic amines.

Specific examples of the photo polymerization promotors which are employed alone or in combination include p-dimethylamino benzoic acid isoamyl ester and p-dimethylamino benzoic acid ethyl ester.

The content of the photo polymerization promoters is preferably from about 0.1 to about 5 parts by weight, and more preferably from about 0.3 to about 3 parts by weight, per 1 part by weight of photo polymerization initiator.

A UV irradiation apparatus useful for crosslinking a resin in the present invention includes a light source, an irradiation element, a power source, a cooling device and a feeding device. Specific examples of the light source include a mercury-vapor lamp, a metal halide lamp, a potassium lamp, a mercury-xenon lamp and a flash lamp. The radiation spectrum of the light source preferably corresponds to the absorption spectrum of the photo polymerization initiator and promotor used. An out put of lamp power and a feeding speed are determined so that the resin in the recording layer can securely be crosslinked.

An electron beam irradiation method useful for crosslinking a resin in the recording layer is hereinafter described. Electron beam irradiation apparatus are broadly classified into scanning type (scan beaming) irradiation apparatus and non-scanning type (area beaming) irradiation apparatus. A suitable irradiation apparatus should be determined in consideration of an irradiation area and an irradiation dose required. Irradiation conditions should be determined by the required irradiation dose of electron beams using the following equation:

$$D=(\Delta E/\Delta R)\cdot\eta\cdot I/(W\cdot V)$$

wherein D is a required irradiation dose (Mrad), $\Delta E/\Delta R$ is an average energy loss, $\eta$ is efficiency, I is an electron beam current (mA), W is an irradiation width (cm) and V is a feeding speed (cm/s).

For industrial purpose, the following simplified equation can be used:

$$D\cdot V=K\cdot I/W.$$

In this equation, the unit of rated output (D·V) of an apparatus is Mrad·m/min. A suitable rated electron beam current is from about 20 to about 30 mA for a laboratory irradiation apparatus, from about 50 to about 100 mA for a pilot irradiation apparatus and from about 100 to 500 mA for a production irradiation apparatus.

A suitable irradiation dose depends on molecular structure and an addition amount of an added crosslinking agent and an added plasticizer because the crosslinking efficiency is changed by these factors. Therefore, levels of these factors and a required gel fraction rate of the recording layer are preliminarily determined and then the required irradiation dose should be determined. When a relatively high irradiation dose is required for crosslinking a resin, an electron beam irradiation may be separated into several times of irradiation to prevent deformation and decomposition of the recording material due to the heat caused by the electron beam irradiation. In addition, crosslinking operations by the electron beam irradiation should be performed after at least one part or one component of the low-molecular-weight organic materials in the recording layer is melted and preferably after all of the low-molecular-weight organic materials in the recording layer are melted.

In order to obtain a relatively high gel fraction rate, characteristics of the recording layer are preferably as follows:

(1) as to a polymerization degree of the resin included in the recording layer, the greater the polymerization rate of the resin becomes, the greater the gel fraction rate, and therefore the polymerization degree of the resin is preferably greater than about 300, and more preferably greater than about 600.

(2) suitable structure and addition amount of the crosslinking agent to be added in the recording layer are aforementioned;

(3) as to structure of the added plasticizer to be added in the recording layer, fatty acid esters, polyester type plasticizers and epoxy type plasticizers are preferable, and particularly the epoxy type plasticizers are most preferable because of having good resistance to discoloration and good crosslinking efficiency; and (4) as to an addition amount of the plasticizer, the greater the addition amount of the plasticizer becomes, the greater the gel fraction rate, and therefore the content of the plasticizer in the recording layer is from about 0.01 to about 1.0 part by weight, and more preferably about 0.05 to 0.5 parts by weight, per 1 part by weight of the resin.

In order to obtain good durability of the recording layer, one or more of the following methods can preferably be used.

Firstly, the melting point of the recording layer should be increased. The melting point of a recording layer can be measured with a thermomechanical analyzer (TMA) or a dynamic modulus of elasticity measuring apparatus using a film of the recording layer whose preparing method is mentioned in the above-described gel fraction rate measuring method. In addition, a dynamic modulus of elasticity measuring apparatus using a rigid pendulum can measure the melting point of a recording layer without removing the recording layer from the recording material.

Secondly, a protective layer is preferably formed on the recording layer to obtain good durability of the recording material. In this case, the greater the adhesion strength between the protective layer and the recording layer becomes, the more durable is the recording material. A method for measuring the adhesion strength is based on Tappi UM-403.

Thirdly, the recording layer preferably has a relatively small penetration. The smaller penetration the recording layer has, the more durable is the recording layer. Penetration of the recording layer is measured using a thermomechanical analyzer (TMA). A probe whose tip end has a small cross-sectional area is set on a recording layer formed on a substrate, and a predetermined load is applied to the probe to measure displacement of the probe, i.e., penetration. The penetration is measured, if necessary, while the recording layer is heated.

Fourthly, the recording layer preferably includes a relatively small amount of residue of a crosslinking agent after being subjected to electron beam crosslinking treatment. The less the amount of residue of a crosslinking agent, the more durable is the recording layer. The amount of residue of a crosslinking agent is measured using an ATR (attenuated total reflection) measuring attachment of a Fourier transform infrared spectrophotometer. The amount of residue of a crosslinking agent can be measured as the intensity of an absorption spectrum formed near a wave number of 810 $cm^{-1}$, which is caused by out-of-CH-plane deformation vibration of an acryloyl group. The less the intensity of the absorption spectrum, the less is the residue of the crosslinking agent. The amount of residue of a crosslinking agent is less than about 0.2 parts, preferably less than about 0.1 parts, more preferably less than about 0.05 parts and even more preferably about 0.01 parts by weight, per 1 part by weight of a resin in the recording layer.

Both the reversible thermo-transparency-changing recording material and the reversible thermo-color-changing recording material may include a protective layer formed on the recording layers to protect the recording layers. Suitable materials for use in the protective layer of the present invention include silicone rubbers and silicone resins which are disclosed in Japanese Laid-Open Patent Application No. 63-221087, polysiloxane graft polymers which are disclosed in Japanese Laid-Open Patent Application No. 63-317385, and ultraviolet crosslinking resins and electron beam crosslinking resins which are disclosed in Japanese Laid-Open Patent Application No. 02-000566. When a solvent is used in a protective layer coating liquid, the solvent preferably hardly dissolve or does not dissolve the recording layer. Suitable solvents for use in protective layer coating liquids include n-hexane, methyl alcohol, ethyl alcohol and isopropyl alcohol. Among these solvents, alcohols are preferable in view of manufacturing cost.

The protective layer may be crosslinked at the same time when the recording layer is crosslinked. Namely, the recording layer which is formed on a substrate but is not crosslinked yet and the protective layer formed thereon may be crosslinked at the same time using, for example, an electron beam irradiation apparatus whose conditions are aforementioned.

The preferable thickness of the protective layer is from about 0.5 to about 10 $\mu$m to protect the recording layer against damage and to maintain good thermosensitivity.

In addition, as disclosed in Japanese Laid-Open Patent Application No. 1-133781, an intermediate layer can be formed between the recording layer and the protective layer to prevent the recording layer from contacting solvents and/or monomers in the protective layer coating liquid. Suitable materials for use in the intermediate layer of the present invention include resins which are aforementioned to be useful for a resin in the recording layer, thermosetting resins and thermoplastic resins such as polyethylene, polypropylene, polystyrene, polyvinyl alcohol, polyvinyl butyral, polyurethane, saturated polyesters, unsaturated polyesters, epoxy resins, phenol resins, polycarbonates and polyamides. The preferable thickness of the intermediate layer is from about 0.1 to about 2 $\mu$m.

The recording material of the present invention may include an information recording section. The information recording section is formed on at least one part of at least one side of the substrate. Specific examples of the information recording section include a magnetic recording layer, an integrated circuit, an optical memory or the like.

The recording material may include a colored layer formed between a substrate and a recording layer to obtain a good visual property, i.e., good contrast, of a formed image. The colored layer is formed by coating a coating liquid including a colorant and a binder resin on a substrate or on a backside of a recording layer and drying the coated liquid, or by laminating a colored sheet to a substrate or the backside of the recording layer. Suitable binder resins for use in the colored layer include known thermoplastic resins, thermosetting resins and ultraviolet crosslinking resins.

Further, an air layer may be formed between a substrate and a recording layer to obtain good contrast of a formed image. Since there is a large gap in refractive index between a resin which is a main material of the recording layer and whose refractive index is from about 1.4 to about 1.6 and air whose refractive index is 1.0, light tends to reflect at an interface between the air layer and the recording layer, resulting in increase of an opacity of an opaque image; thereby an image having good contrast can be obtained. Therefore, the recording material having such an air layer is suitable for display devices. The air layer also has a good heat insulating property and therefore the heat sensitivity of the recording material increases. Further, since the air layer functions as a cushion, effective pressure applied to the recording layer with a thermal printhead is decreased while the thermal printhead evenly contacts the recording layer, resulting in prevention of deformation of the recording material and prevention of growth of the low-molecular-weight organic material particles; thereby good durability of the recording material can be obtained.

Furthermore, the recording material may include a print layer which is formed overlying the protective layer and/or the backside of the substrate and which includes a colorant such as dyes or pigments used for printing ink or the like and a binder resin such as thermoplastic resins, thermosetting resins, UV crosslinkable resins and electron beam crosslinkable resins. The thickness of the print layer depends on a desired image density of a print image.

Furthermore, the recording material may include a heat resistant layer which is formed overlying the protective layer and which includes a heat resistant resin and an inorganic pigment to maintain good ability to be used with thermal printheads. Specific examples of such a heat resistant resin include aforementioned resins useful for a resin of the protective layer. Specific examples of such an inorganic pigment include calcium carbonate, kaolin, silica, aluminum hydroxide, alumina, aluminum silicate, magnesium hydroxide, magnesium carbonate, titanium dioxide, zinc oxide, barium sulfate, talc or the like. The particle diameter of the inorganic pigment is preferably about 0.01 to about 10.0 $\mu$m, and more preferably about 0.05 to about 8.0 $\mu$m. These inorganic pigments are employed alone or in combination. The content of the inorganic pigment in the heat resistant layer is preferably from about 0.001 to about 2 parts by weight, and more preferably from about 0.005 to about 1 part by weight, per 1 part by weight of the heat resistant resin.

When the resins included in the protective layer, the print layer and the heat resistant layer are needed to be crosslinked by a UV light irradiation crosslinking method, the aforementioned crosslinking agents, photo polymerization initiators and photo polymerization promoters can preferably be added.

Furthermore, the recording material may include an adhesive agent layer formed on a backside of the substrate to enable it to be used as a reversible thermosensitive recording material label. The reversible thermosensitive recording material label can be adhered to credit cards, IC cards, ID cards, paper, films, synthetic paper, boarding passes, commuter passes or the like.

In addition, if the substrate has poor adhesion strength such as an aluminum metallized substrate, an adhesive layer may be formed between the substrate and the recording layer, which is disclosed in Japanese Laid-Open Patent Application No. 3-7377.

As recording apparatus useful for repeatedly recording images in the recording material of the present invention, various known thermal recording apparatus can be employed. Specific examples of such apparatus include:

(1) a thermal recording apparatus having a heating device such as a thermal printhead which repeatedly records and erases images; and (2) a thermal recording apparatus having two heating devices such as a thermal printhead which repeatedly records images, and another heating device which is used for erasing images and selected from heating devices such as thermal printheads, ceramic heaters (a heater in which a heating resistor is formed on an alumina substrate), hot stamping devices, heating rollers, heating blocks, hot air blowing devices, infrared light irradiating devices or the like.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Formation of Recording Material)

The following compounds were mixed to prepare a magnetic recording layer coating liquid:

| | |
|---|---|
| γ-Fe2O3 | 10 |
| vinyl chloride-vinyl acetate-vinyl alcohol copolymer (VAGH, manufactured by Union Carbide Corp.) | 10 |
| isocyanate compound (Colonate L, manufactured by Nippon Polyurethane Co., Ltd., 50% toluene solution) | 2 |
| methyl ethyl ketone | 40 |
| toluene | 40 |

The magnetic layer coating liquid was coated on a polyester film 188 $\mu$m thick with a wire bar and dried by heating to form a magnetic recording layer 10 $\mu$m thick.

The following compounds were mixed to prepare a smoothing layer coating liquid:

| | |
|---|---|
| UV crosslinkable acrylic resin (Unidic C7-164, manufactured by Dainippon Ink and Chemicals Inc., 49% butyl acetate solution) | 10 |
| toluene | 4 |

The smoothing layer coating liquid was coated on the magnetic recording layer with a wire bar, dried by heating and then irradiated with a UV lamp of 80 W/cm for 5 sec. to form a smoothing layer 1.5 $\mu$m thick.

Then an aluminum thin layer having a thickness of 400 Å was formed on the smoothing layer by a vacuum evaporation coating to form a light-reflective layer.

The following compounds were mixed to prepare an adhesive layer coating liquid:

| | |
|---|---|
| vinyl chloride-vinyl acetate-phosphoric acid ester copolymer (Denka Vinyl #1000P, manufactured by Denki Kagaku Kogyo K.K.) | 5 |
| tetrahydrofuran | 95 |

The adhesive layer coating liquid was coated on the aluminum layer of the polyester film and dried to form an adhesive layer 1.5 $\mu$m thick.

The following compounds were mixed to prepare a recording layer coating liquid:

| | |
|---|---|
| 1, 18-octadecamethylenedicarboxylic acid dodecyl (manufactured by Miyoshi Oil & Fat Co., Ltd.) | 4.75 |
| eicosanedioic acid (manufactured by Okamura Oil Mill, Ltd.) | 5.25 |
| vinyl chloride-vinyl acetate copolymer (M2018, manufactured by Kaneka Corp., vinyl chloride:vinyl acetate = 80:20 by mole ratio, average degree of polymerization of 1800) | 28 |
| reactive polymer (NK Polymer B-3015H, manufactured by Shin-Nakamura Chemical Co., Ltd.) | 4.7 |
| tetrahydrofuran | 215.5 |
| amyl alcohol | 24 |
| dibutyl tin laurate type stabilizer (Stann SCAT-1, manufactured by Sankyo Organic Chemicals Co., Ltd.) | 0.8 |

The coating liquid was coated on the light reflective layer and dried to form a recording layer having a thickness of 8

μm. The recording layer was then subjected to electron beam irradiation treatment using an area beam type electron beam irradiation apparatus EBC-200-AA2 manufactured by Nisshin Highvoltage Co., Ltd. in an irradiation dose of 10 Mrad. The gel fraction rate of the recording layer was 90%.

The following compounds were mixed to prepare an intermediate layer coating liquid:

| | |
|---|---|
| vinyl chloride-vinyl acetate copolymer (M2018, manufactured by Kanegafuchi Chemical Industries Co., Ltd.) | 10 |
| Unidic C4-782 (manufactured by Dainippon Ink and Chemicals, Inc.) | 2.5 |
| tetrahydrofuran | 87.5 |

The intermediate layer coating liquid was coated on the recording layer and dried to form an intermediate layer. The gel fraction rate of the intermediate layer was 46%.

The following compounds were mixed to prepare a protective layer coating liquid:

| | |
|---|---|
| urethaneacrylate UV light crosslinkable resin (Unidic C7-157, manufactured by Dainippon Ink and Chemicals Inc., butyl acetate solution having a solid content of 75%,) | 10 |
| isopropyl alcohol | 10 |

The protective layer coating liquid was coated on the intermediate layer with a wire bar and dried to form a protective layer. The protective layer was crosslinked with a UV lamp of 80 W/cm. The thickness of the protective layer was 3 μm.

Thus, a reversible thermosensitive recording material of the present invention was obtained.

Example 2

The procedure for preparation of the reversible thermosensitive recording material in Example 1 was repeated except that the amount of the reactive polymer in the recording layer coating liquid was changed from 4.7 to 3.5 parts. The gel fraction rate of the resin in the recording layer was 86%. Thus, a reversible thermosensitive recording material of the present invention was obtained.

Example 3

The procedure for preparation of the reversible thermosensitive recording material in Example 1 was repeated except that the amount of the reactive polymer in the recording layer coating liquid was changed from 4.7 to 7.5 parts. The gel fraction rate of the resin in the recording layer was 93%. Thus, a reversible thermosensitive recording material of the present invention was obtained.

Example 4

The procedure for preparation of the reversible thermosensitive recording material in Example 1 was repeated except that the amount of the reactive polymer in the recording layer coating liquid was changed from 4.7 to 10 parts. The gel fraction rate of the resin in the recording layer was 95%. Thus, a reversible thermosensitive recording material of the present invention was obtained.

Example 5

The procedure for preparation of the reversible thermosensitive recording material in Example 1 was repeated except that the reactive polymer, B-3015H, in the recording layer coating liquid was replaced with 4.7 parts by weight of a reactive polymer, B-3015HS, manufactured by Shinnakamura Chemical Industries Co., Ltd. The gel fraction rate of the resin in the recording layer was 85%. Thus, a reversible thermosensitive recording material of the present invention was obtained.

Example 6

The procedure for preparation of the reversible thermosensitive recording material in Example 5 was repeated except that B-3015HS in the recording layer was replaced with the following compounds:

| | |
|---|---|
| reactive polymer NK Polymer B-3015H (manufactured by Shin-Nakamura Chemical Co., Ltd.) | 2.35 |
| acrylic monomer NK ESTER ATM-4E (manufactured by Shin-Nakamura Chemical Co., Ltd.) | 2.35 |

The gel fraction rate of the resin in the recording layer was 90%. Thus, a reversible thermosensitive recording material was obtained.

Example 7

The procedure for preparation of the reversible thermosensitive recording material in Example 5 was repeated except that B-3015HS in the recording layer was replaced with the following compounds:

| | |
|---|---|
| reactive polymer NK Polymer B-3015H (manufactured by Shin-Nakamura Chemical Co., Ltd.) | 2.35 |
| acrylic monomer NK ESTER ATM-4P (manufactured by Shin-Nakamura Chemical Co., Ltd.) | 2.35 |

The gel fraction rate of the resin in the recording layer was 89%. Thus, a reversible thermosensitive recording material was obtained.

Example 8

The procedure for preparation of the reversible thermosensitive recording material in Example 5 was repeated except that B-3015HS in the recording layer was replaced with the following compounds:

| | |
|---|---|
| reactive polymer NK Polymer B-3015H (manufactured by Shin-Nakamura Chemical Co., Ltd.) | 3.29 |
| acrylic monomer NK ESTER ATM-4E (manufactured by Shin-Nakamura Chemical Co., Ltd.) | 1.41 |

The gel fraction rate of the resin in the recording layer was 86%. Thus, a reversible thermosensitive recording material was obtained.

Comparative Example 1

The procedure for preparation of the reversible thermosensitive recording material in Example 1 was repeated except that the reactive polymer in the recording layer coating liquid was replaced with 4.7 parts by weight of an acrylic monomer, Kayarad DPCA-30, manufactured by Nippon Kayaku Co., Ltd. The gel fraction rate of the resin in the recording layer was 93%. Thus, a comparative reversible thermosensitive recording material was obtained.

Comparative Example 2

The procedure for preparation of the reversible thermosensitive recording material in Example 1 was repeated except that the reactive polymer in the recording layer coating liquid was replaced with 4.7 parts by weight of an acrylic monomer, NK ESTER A-9530, manufactured by Shin-Nakamura Chemical Co., Ltd. The gel fraction rate of the resin in the recording layer was 92%. Thus, a comparative reversible thermosensitive recording material was obtained.

Comparative Example 3

The procedure for preparation of the reversible thermosensitive recording material in Example 1 was repeated except that the reactive polymer in the recording layer coating liquid was replaced with 4.7 parts by weight of an acrylic monomer, NK ESTER A-TMPT-3PO, manufactured by Shin-Nakamura Chemical Co., Ltd. The gel fraction rate of the resin in the recording layer was 85%. Thus, a comparative reversible thermosensitive recording material was obtained.

Comparative Example 4

The procedure for preparation of the reversible thermosensitive recording material in Example 1 was repeated except that the reactive polymer in the recording layer coating liquid was replaced with 4.7 parts by weight of the acrylic monomer, NK ESTER ATM-4E, manufactured by Shin-Nakamura Chemical Co., Ltd. The gel fraction rate of the resin in the recording layer was 88%. Thus, a comparative reversible thermosensitive recording material was obtained.

Comparative Example 5

The procedure for preparation of the reversible thermosensitive recording material in Example 1 was repeated except that the reactive polymer in the recording layer coating liquid was replaced with 4.7 parts by weight of an acrylic monomer, NK ESTER AD-TMP, manufactured by Shin-Nakamura Chemical Co., Ltd. The gel fraction rate of the resin in the recording layer was 89%. Thus, a comparative reversible thermosensitive recording material was obtained.

The obtained reversible thermosensitive recording materials of Examples 1 to 8 and Comparative Examples 1 to 5 were evaluated by the following methods.

(1) changing rate of first color recordable energy range (a) second color (opaque) image recording method Each recording material which was in a transparent state was set in a thermal recording simulator manufactured by Yashiro Electric Co., Ltd. and heated to form a saturated opaque image therein using the following conditions:

thermal printhead: edge type printhead EUX-ET8A9AS1, manufactured by Matsushita Electronic Components Co., Ltd.

dot density of main scanning: 8 dots/mm dot density of vertical scanning: 16 lines/mm pulse width: 2 msec cycle time: 2.86 msec recording speed: 21.50 mm/sec pressure of platen roller: 2 kg/cm$^2$ recording energy: 0.3 mJ/dot (the applied voltage was 14.0 v which was preliminarily determined as an optimum recording energy)

(b) first color (transparent) image recording method

Each of the opaque images was then heated with a heat energy of 0.176 mJ/dot (an applied voltage of 11.0 v) to obtain a transparent image while the other conditions were the same as mentioned in (a). The image density of the transparent state of each recording material, i.e., a ground density, was measured by a reflective densitometer.

Each of the recorded opaque images of the recording materials was then erased by changing the applied energy (i.e., the applied voltage was changed from 8 to 15 v) to obtain a minimum first color recordable energy and a maximum first color recordable energy.

(c) method for obtaining changing rate of first recordable energy range

A minimum first color recordable energy and a maximum first color recordable energy were obtained between which the difference between the image density of the transparent state and the ground density of the recording layer was kept to be 0.1 or less.

A first color recordable energy range was obtained as a difference of the maximum first color recordable energy and the minimum first color recordable energy. A minimum first color recordable energy, a maximum first color recordable energy and a first color recordable energy range of each of the recorded opaque images of the recording materials were obtained after the recorded opaque images were preserved at 35° C. for 48 hours.

The results are shown in Tables 1–1 and 1–2.

(2) contrast of image

Each recording material which was in a transparent state was set in a thermal recording simulator manufactured by Yashiro Electric Co., Ltd. and heated to form an opaque image therein using the same conditions as mentioned above. The image density of the opaque image was measured with a reflection densitometer manufactured by Macbeth Co. after the opaque image was cooled to room temperature. The opaque image was erased by heat using the above-mentioned conditions except that the heating energy was changed to 0.176 mJ/dot (an applied voltage of 11.0 v). The erased image was cooled to room temperature and the image density thereof which was an initial density of the first color was measured with a reflection densitometer manufactured by Macbeth Co. The contrast of an image was represented by a difference between the image density of an opaque image and the image density of the erased image.

By using the same method as mentioned above, an image density of the erased image and a contrast of the image of each recording material were obtained after the recording material was preserved at 35° C. for 48 hours while being in an opaque state.

The results are shown in Tables 2–1 and 2–2.

TABLE 1-1

| | initial values (mJ/dot) | | |
|---|---|---|---|
| | minimum first color recordable energy | maximum first color recordable energy | first color recordable energy range |
| Example 1 | 0.1567 | 0.2200 | 0.0633 |
| Example 2 | 0.1600 | 0.2200 | 0.0600 |
| Example 3 | 0.1550 | 0.2200 | 0.0650 |
| Example 4 | 0.1533 | 0.2200 | 0.0667 |
| Example 5 | 0.1530 | 0.2200 | 0.0670 |
| Example 6 | 0.1566 | 0.2217 | 0.0651 |
| Example 7 | 0.1530 | 0.2200 | 0.0670 |
| Example 8 | 0.1565 | 0.2217 | 0.0652 |
| Comparative Example 1 | 0.1717 | 0.2217 | 0.0500 |
| Comparative | 0.1883 | 0.2200 | 0.0317 |

TABLE 1-1-continued

| | initial values (mJ/dot) | | |
|---|---|---|---|
| | minimum first color recordable energy | maximum first color recordable energy | first color recordable energy range |
| Example 2 | | | |
| Comparative Example 3 | 0.1700 | 0.2167 | 0.0467 |
| Comparative Example 4 | 0.1700 | 0.2167 | 0.0467 |
| Comparative Example 5 | 0.1883 | 0.2167 | 0.0334 |

TABLE 1-2

| | values after opaque image was preserved at 35° C. for 48 hrs. (mJ/dot) | | | changing rate of first color |
|---|---|---|---|---|
| | minimum first energy recordable energy | maximum first energy recordable energy | first color recordable energy range | recordable energy range (%) |
| Example 1 | 0.1700 | 0.2200 | 0.0500 | 21.0 |
| Example 2 | 0.1717 | 0.2200 | 0.0483 | 19.5 |
| Example 3 | 0.1650 | 0.2200 | 0.0550 | 15.4 |
| Example 4 | 0.1625 | 0.2200 | 0.0575 | 13.8 |
| Example 5 | 0.1584 | 0.2200 | 0.0616 | 8.1 |
| Example 6 | 0.1566 | 0.2217 | 0.0651 | 0 |
| Example 7 | 0.1653 | 0.2200 | 0.0547 | 18.4 |
| Example 8 | 0.1668 | 0.2217 | 0.0549 | 15.8 |
| Comparative Example 1 | 0.2000 | 0.2217 | 0.0217 | 56.6 |
| Comparative Example 2 | — | — | 0 | 100 |
| Comparative Example 3 | 0.1883 | 0.2167 | 0.0284 | 39.2 |
| Comparative Example 4 | 0.1883 | 0.2167 | 0.2167 | 60.6 |
| Comparative Example 5 | 0.2100 | 0.2200 | 0.0100 | 70.1 |

TABLE 2-1

| | | initial values | |
|---|---|---|---|
| | image density of opaque image | image density of erased image | contrast of image |
| Example 1 | 0.25 | 1.06 | 0.81 |
| Example 2 | 0.23 | 1.06 | 0.83 |
| Example 3 | 0.27 | 1.07 | 0.80 |
| Example 4 | 0.28 | 1.09 | 0.81 |
| Example 5 | 0.30 | 1.12 | 0.82 |
| Example 6 | 0.25 | 1.07 | 0.82 |
| Example 7 | 0.23 | 1.06 | 0.83 |
| Example 8 | 0.24 | 1.07 | 0.83 |
| Comparative Example 1 | 0.24 | 1.01 | 0.77 |
| Comparative Example 2 | 0.23 | 0.47 | 0.24 |
| Comparative Example 3 | 0.33 | 1.03 | 0.70 |
| Comparative Example 4 | 0.23 | 1.01 | 0.78 |
| Comparative Example 5 | 0.24 | 0.63 | 0.39 |

TABLE 2-2

| | values after opaque image was preserved at 35° C. for 48 hrs. | |
|---|---|---|
| | image density of erased color image | contrast of image |
| Example 1 | 1.05* | 0.80 |
| Example 2 | 1.01* | 0.78 |
| Example 3 | 1.06* | 0.79 |
| Example 4 | 1.06* | 0.78 |
| Example 5 | 1.10* | 0.80 |
| Example 6 | 1.03* | 0.78 |
| Example 7 | 1.03* | 0.80 |
| Example 8 | 1.02* | 0.78 |
| Comparative Example 1 | 0.32** | 0.08 |
| Comparative Example 2 | 0.27** | 0.04 |
| Comparative Example 3 | 0.73** | 0.40 |
| Comparative Example 4 | 0.41** | 0.18 |
| Comparative Example 5 | 0.38** | 0.14 |

*The erased images of the recording materials of the present invention have good transparency, so that the image density is almost equal to the reflective density of the light reflective layer.

**The erased images of the comparative recording materials have poor transparency, i.e., being in a semi-opaque state, so that the image densities are relatively low compared with those of the recording materials of the present invention.

The results in Tables 1-1, 1-2, 2-1 and 2-1 clearly indicate that the reversible thermosensitive recording materials of the present invention can clearly erase the opaque images, i.e., produce good transparent images, even after the recording materials in the opaque state are preserved in a relatively high temperature environment for a long time. In other words, the recording materials have good contrast of images, i.e., good readability.

Additional modifications and variations of the present invention are possible in light of the above teachings. It is therefore to be understood that within the scope of the appended claims the invention may be practiced other than as specifically described herein.

This application is based on Japanese Patent Application No. 08-221867, filed on Aug. 6, 1996, the entire contents of which are herein incorporated by reference.

What is claimed is:

1. A reversible thermosensitive recording material comprising a substrate having at least two opposed sides and a recording layer which is formed overlying at least one part of at least one side of the substrate, the recording layer comprising a particulate low-molecular weight organic material dispersed in a resin and from about 5% to about 60% of a reactive polymer and having first and second color states, in which the color state of the recording layer becomes a first color state at a first coloring temperature higher than room temperature when the recording layer is heated by applying heat energy in a first color recordable energy range and in which the color state of the recording layer then becomes a second color state when the recording layer is heated at a second coloring temperature higher than the first coloring temperature and then cooled, wherein provided that an initial first color recordable energy range of the recording material is (E1) and a changed first color recordable energy range of the recording material which has been preserved at 35° C. for 48 hours while keeping the second color state is (ED), a changing rate (EC) which is represented by the following equation is less than about 35%:

$$EC+\{(E1-ED)/E1\}\times 100.$$

2. The reversible thermosensitive recording material of claim 1, wherein the recording layer is heated with a thermal printhead to be in the first color state and the initial first color recordable energy range (E1) is greater than about 0.04 mJ/dot and the changed first color recordable energy range (ED) is greater than about 0.025 mJ/dot.

3. The reversible thermosensitive recording material of claim 1, wherein the recording layer is heated with a thermal printhead to be in the first color state and the maximum value of the first color recordable energy range is less than about 0.8 mJ/dot.

4. The reversible thermosensitive recording material of claim 1, wherein one of the first and the second color states is an opaque state and the other color state is a transparent state.

5. The reversible thermosensitive recording material of claim 4, wherein the recording layer comprises a resin and a particulate low-molecular-weight organic material which is dispersed in the resin, and wherein the resin is crosslinked.

6. The reversible thermosensitive recording material of claim 5, wherein the gel fraction rate of the resin is greater than about 30%.

7. The reversible thermosensitive recording material of claim 5, wherein the resin is crosslinked by at least one of an electron beam irradiation method, an ultraviolet light irradiation method and a heating method.

8. The reversible thermosensitive recording material of claim 5, wherein the particulate low-molecular-weight organic material comprises a particulate low-molecular-weight organic material having a melting point of about 50 to about 80° C. and a particulate low-molecular-weight organic material having a melting point of about 110 to about 180° C.

9. The reversible thermosensitive recording material of claim 8, wherein the particulate low-molecular-weight organic material having a melting point of about 50 to about 80° C. comprises at least one of fatty acid esters, dibasic fatty acid esters and fatty acid diesters of polyhydric alcohol.

10. The reversible thermosensitive recording material of claim 1, wherein the reversible thermosensitive recording material further comprises an information recording section.

11. The reversible thermosensitive recording material of claim 10, wherein the information recording section comprises a magnetic recording layer which is formed on at least one part of at least one side of the opposed sides of the substrate.

12. The reversible thermosensitive recording material of claim 10, wherein the information recording section comprises at least one of an integrated circuit and an optical memory.

13. The reversible thermosensitive recording material of claim 1, wherein the substrate comprises a laminated substrate in which two or more substrates are laminated.

14. The reversible thermosensitive recording material of claim 1, wherein the reversible thermosensitive recording material further comprises a protective layer which is formed overlying the recording layer and which comprises a heat resistant resin.

15. The reversible thermosensitive recording material of claim 14, wherein the reversible thermosensitive recording material further comprises a print layer which comprises a colorant and a resin and which is formed overlying at least one part of at least one side of the opposed sides of the substrate.

16. The reversible thermosensitive recording material of claim 14, wherein the reversible thermosensitive recording material further comprises a heat resistant layer which comprises a heat resistant resin and an inorganic pigment and which is formed overlying the protective layer.

17. The reversible thermosensitive recording material of claim 1, wherein the reversible thermosensitive recording material further comprises an air layer between the substrate and the recording layer.

18. A reversible thermosensitive recording material having a substrate having at least two opposed sides and a recording layer which is formed overlying at least one part of at least one side of the substrate, the recording layer having first and second color states, in which the color state of the recording layer becomes a first color state at a first coloring temperature higher than room temperature when the recording layer is heated by applying heat energy in a first color recordable energy range, and in which the color state of the recording layer then becomes a second color state when the recording layer is heated at a second coloring temperature higher than the first coloring temperature and then cooled, wherein the recording layer comprises a particulate low-molecular weight organic material dispersed in a resin and from about 5% to about 60% of a reactive polymer.

19. The reversible thermosensitive recording material of claim 18, wherein the recording layer further comprises a resin and a particulate low-molecular-weight organic material which is dispersed in the resin, and wherein the resin is crosslinked.

20. The reversible thermosensitive recording material of claim 19, wherein the gel fraction rate of the resin is greater than about 30%.

21. The reversible thermosensitive recording material of claim 19, wherein the resin is crosslinked by at least one of an electron beam irradiation method, an ultraviolet light irradiation method and a heating method.

22. The reversible thermosensitive recording material of claim 18, wherein the reversible thermosensitive recording material further comprises an information recording section.

23. The reversible thermosensitive recording material of claim 22, wherein the information recording section comprises a magnetic recording layer which is formed on at least one part of the opposed sides of the substrate.

24. The reversible thermosensitive recording material of claim 22, wherein the information recording section comprises at least one of an integrated circuit and an optical memory.

25. The reversible thermosensitive recording material of claim 18, wherein the substrate comprises a laminated substrate in which two or more substrates are laminated.

26. The reversible thermosensitive recording material of claim 18, wherein the reversible thermosensitive recording material further comprises a protective layer which is formed overlying the recording layer and which comprises a heat resistant resin.

27. The reversible thermosensitive recording material of claim 26, wherein the reversible thermosensitive recording material further comprises a print layer which comprises a colorant and a resin and which is formed overlying at least one part of at least one side of the opposed sides of the substrate.

28. The reversible thermosensitive recording material of claim 26, wherein the reversible thermosensitive recording material further comprises a heat resistant layer which comprises a heat resistant resin and an inorganic pigment and which is formed overlying the protective layer.

29. A reversible image forming method comprising:

preparing a reversible thermosensitive recording material comprising a substrate having at least two opposed sides and a recording layer which is formed overlying at least one part of one side of the substrate, said recording layer comprising a particulate low-molecular weight organic material dispersed in a resin and from about 5% to about 60% of a reactive polymer;

firstly-heating the recording layer at a first coloring temperature higher than room temperature by applying heat energy in a first color recordable energy range of the recording layer to form a first color image in the recording layer;

secondly-heating the recording layer at a second coloring temperature higher than the first coloring temperature; and cooling the recording layer to form a second color image in the recording layer, wherein provided that an initial first color recordable energy range is (E1) and a changed first color recordable energy range of the recording material which has been preserved at 35° C. for 48 hours while being in a second color state is (ED), a changing rate (EC) which is represented by the following equation is less than about 35%:

$$EC=\{(E1-ED)/E1\}\times 100.$$

30. The reversible image forming method of claim 29, wherein the firstly-heating and secondly-heating are performed with one or more thermal printheads.

31. The reversible image forming method of claim 29, wherein the firstly-heating is performed with one of heating devices comprising a thermal printhead, a ceramic heater, a hot stamp, a heat roller and a heat block.

32. A reversible image forming method comprising:

preparing a reversible thermosensitive recording material comprising a substrate having at least two opposed sides and a recording layer which is formed overlying at least one part of one side of the substrate;

firstly-heating the recording layer at a first coloring temperature higher than room temperature by applying heat energy in a first color recordable energy range of the recording layer to form a first color image in the recording layer;

secondly-heating the recording layer at a second coloring temperature higher than the first coloring temperature; and cooling the recording layer to form a second color image in the recording layer, wherein the recording layer comprises a particulate low-molecular weight organic material dispersed in a resin and from about 5% to about 60% of a reactive polymer.

33. The reversible image forming method of claim 32, wherein the firstly-heating and secondly-heating are performed with one or more thermal printheads.

34. The reversible image forming method of claim 32, wherein the firstly-heating is performed with one of heating devices comprising a thermal printhead, a ceramic heater, a hot stamp, a heat roller and a heat block.

* * * * *